United States Patent [19]

Haffey et al.

[11] Patent Number: 4,987,662

[45] Date of Patent: Jan. 29, 1991

[54] SEAT BELT RELEASE GUARD

[75] Inventors: David J. Haffey, 10 Carrothers Court, Saskatoon, Saskatchewan, Canada, S7L 6T3; Susan C. Haffey; Orville Olm, both of Saskatoon, Canada

[73] Assignee: David J. Haffey, Saskatoon, Canada

[21] Appl. No.: 428,182

[22] Filed: Oct. 27, 1989

[51] Int. Cl.[5] ..... A44B 11/26

[52] U.S. Cl. ..... 24/633

[58] Field of Search ..... 24/633, 573, 574, 632–657; 297/468; 292/DIG. 2, DIG. 11, DIG. 65

[56] References Cited

U.S. PATENT DOCUMENTS 4,497,094 2/1985 Morris .
4,502,194 3/1985 Morris et al. .
4,624,033 11/1986 Orton .
4,674,303 6/1987 Salcone, II .
4,675,954 6/1987 Gullickson .
4,731,912 3/1988 Boriskie et al. .
4,878,277 11/1989 Portuese ..... 24/633

FOREIGN PATENT DOCUMENTS

WO84-01275 4/1984 PCT Int'l Appl. ..... 24/633

*Primary Examiner*—James R. Brittain
*Attorney, Agent, or Firm*—Irell & Manella

[57] ABSTRACT

The device consists of a base channel detachably secured to the buckle element of a seat belt so that the buckle rests in the channel and secures the channel to the buckle. A hinged cover can be closed and detachably locked over the buckle so that the release button, either on top or in the front of the buckle assembly, is covered. Pressure on the two sides of the cover releases the latch connection on each side of the device which normally holds the cover closed over the buckle mechanism of the seat belt.

18 Claims, 2 Drawing Sheets

SEAT BELT RELEASE GUARD

BACKGROUND OF THE INVENTION

This invention relates to new and useful improvements in release guards for seat belts on automobiles and other vehicles.

Seat belts which are used to retain both small children and children's car seats in position, are easily released by young children who quickly learn that a push of the button on the seat belt buckle, releases same. This action is not always noticeable by the driver, particularly if the child is in a car seat situated in the rear seat of an automobile as is conventional.

Once the seat belt has been unbuckled by the child, whether in a car seat or in the automobile seat itself it is relatively easy for the child to reach the door and open same apart from the obvious danger of being loose in the car without being buckled in, in the event of a sudden stop or accident.

The present device overcomes this problem of young children either inadvertently or purposely releasing the seat belt mechanism yet at the same time permits rapid emergency quick release operation.

It has been found that once a child is old enough to manipulate the guard release, he or she is old enough to understand the importance of not interfering with the seat belt mechanism while the car is moving.

Prior art known to the applicant includes the following patents:

U.S. Pat. No. 4,674,303 issued June 23, 1987 to Paula J. Salcone shows a safety lock for a seat belt buckle which is designed specifically for a top release buckle and cannot be used in an end release situation inasmuch as the lid or cover hinges parallel to the longitudinal axis of the seat belt.

U S. Pat. No. 4,497,094 issued Feb. 5, 1985 to Roy E. Morris shows a safety sleeve engaged over the seat buckle assembly and can only be release by a relatively small member such as the ignition key engaged through a small aperture in the sleeve in order to depress the latch button of the seat belt. Once again this is for top button type seat belts only.

U.S. Pat. No. 4,502,194 issued Mar. 5, 1985 to Roy E. Morris shows a method similar to the previous patent once again requiring a small tool to be engaged through a small aperture in order to release the top or upper mounted release button of a seat belt.

U.S. Pat. No. 4,624,033 issued Nov. 25, 1986 to Dale W. Orton shows a relatively involved safety seat belt securement device which partially covers the release button so that direct access is restricted. Actuator mechanism is difficult if not impossible for a young child to operate due to its complicated or multi-step operation or force required for actuating same.

U S. Pat. No. 4,675,954 issued June 30, 1987 to Daniel J. Gullickson shows a cover or sleeve for a seat belt having an upper surface which is resilient so that only an adult can depress the upper surface in order to engage the seat belt button therebelow.

U.S. Pat. No. 4,731,912 issued Mar. 22, 1988 to Helen A. Boriskie et al shows a side hinged cover adapted for use with a central upper release type seat belt assembly and cannot be used for end release type seat belts as the end flanges hold the device in position and cover an end release mechanism.

The present invention overcomes many of the disadvantages inherent with prior art devices and in accordance with the invention there is provided a seat belt release guard for use with a seat belt assembly in which said seat belt includes a latch plate on one free end and a latch plate receiving buckle assembly on the other free end, said latch plate receiving buckle assembly including a spring release member thereon, said release guard comprising in combination a buckle assembly receiving component and a cover component hingedly secured to adjacent one end of said receiving component and moveable in an arc parallel to the longitudinal axis of said release guard, from an open, unguarded buckle release position to a closed, guarded position detachably covering the associated spring release member against inadvertent access, means to detachably latch said cover component to said receiving component when in the closed position, means to selectively release said cover component from said release component to move said cover component to the open unguarded position and means to detachably secure said release guard to the associated buckle assembly.

Another advantage of the invention is to provide a device in which the cover component can be adjusted vertically relative to the receiving component to accommodate seat belt buckle assemblies of different thicknesses.

A still further advantage of the invention is to provide a device which is useable with top release and end release type seat belts.

Still another advantage of the invention is to provide a device which is easily secured to the underside of a seat belt buckle assembly and can be removed when desired.

A still further advantage of the invention is to provide a device with the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
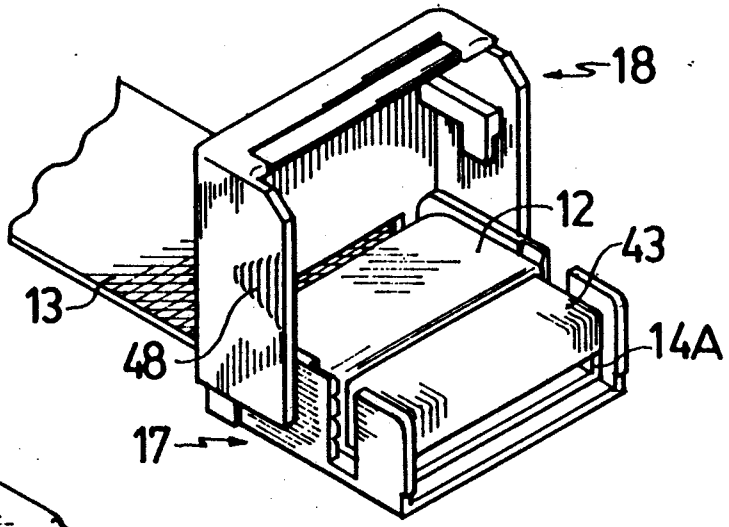
FIG. 2 is a view similar to the buckle end portion of FIG. 1 but showing the cover in the raised position and designed for use with end release seat belts.
Figure 1:
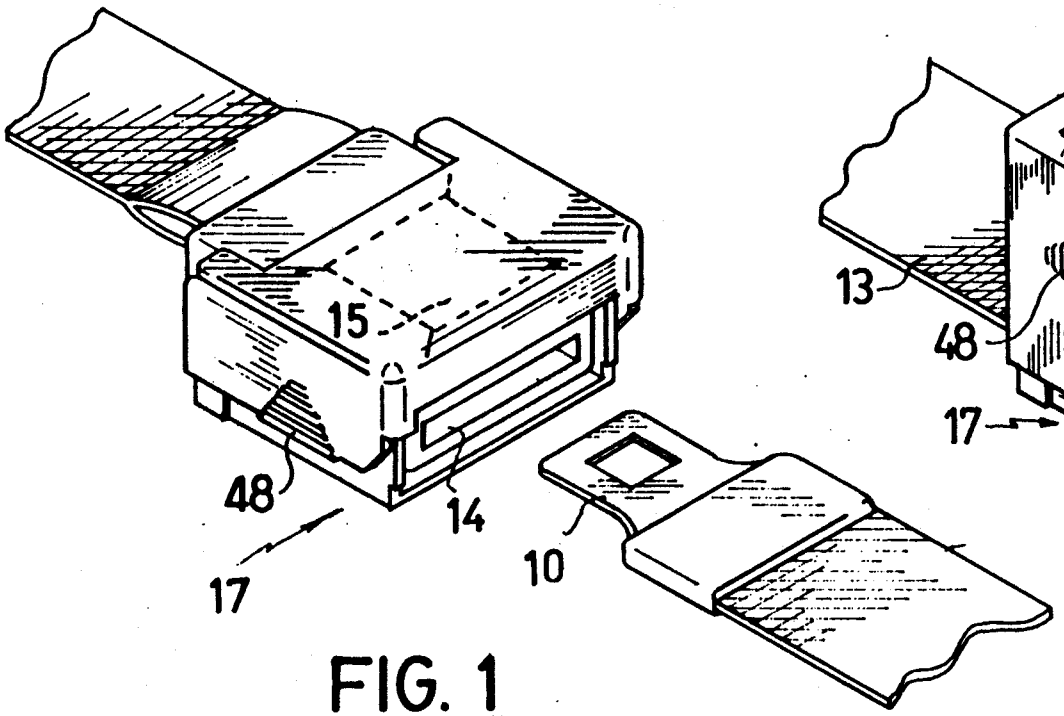
FIG. 1 is an isometric view of the device shown in the closed position over the buckle assembly of a seat belt and designed for use with top release seat belts.

Proceeding therefore to describe the invention in detail, reference should first be made to FIGS. 1 and 2 which shows a portion of a seat belt assembly including the engaging tongue 10 on one free end of one side 11 of a seat belt and the buckle assembly 12 secured to the free end of the other portion 13 of the seat belt assembly.

It will be noted that the buckle assembly 12 includes the transverse slot 14 into which the latch plate 10 may engage and can only be released by depression of the central release button of the buckle assembly identified by reference character 15.

The invention collectively designated 17 consists of a guard preferably made of plastic and comprising two components, a buckle assembly receiving component collectively designated 17 and a cover component collectively designated 18.

Figure 3:
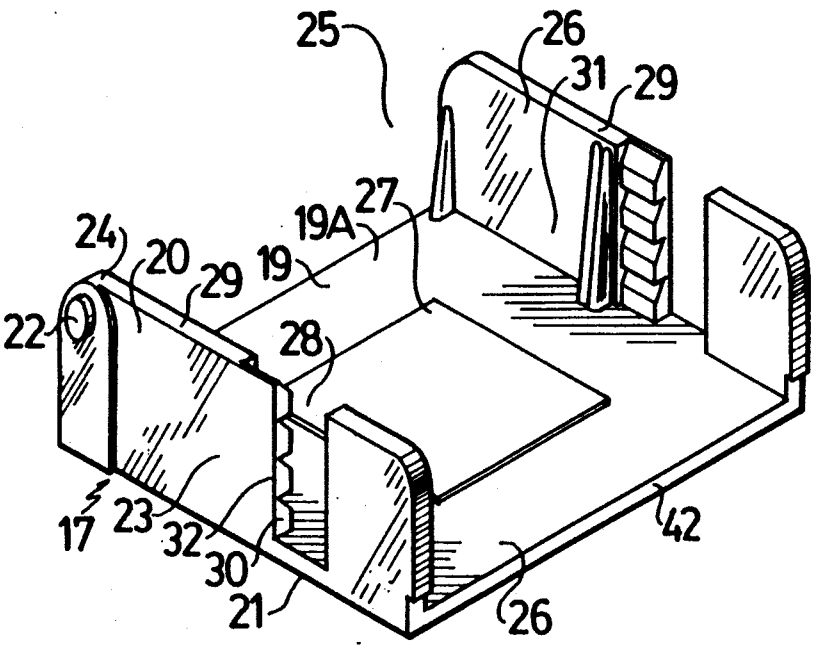
FIG. 3 is an enlarged isometric view of the buckle receiving portion of the device.

The receiving component 17 is shown in detail in FIG. 3 and consists of a substantially rectangular base 19 having an upstanding side member 20 on each side edge 21 of the base, said side members extending upwardly and spaced in parallel relationship perpendicular to the plane of the base 19 as clearly shown.

Hinge pins or lugs 22 extend outwardly from the outer surface 23 of the side members and adjacent the upper rear corners 24 thereof to which the cover member is hingedly attached as will hereinafter be described.

It will be noted that the channel forming the receiving component 17 is open-ended and includes the rear end 25. The dimensions of the receiving component 17 are such that it snugly receives the aforementioned buckle assembly 12 of a seat belt which enters from the rear end 22 and extends to adjacent the front end 26 and the receiving component 17 is secured to the underside of the seat buckle assembly 12 by means of a portion of adhesive mounting tape 27 preferably in the form of two-sided tape, one side of which is adhesively secured to the upper surface 19A of the base 19.

When it is desired to install the guard to the buckle assembly 12, the protective layer (not indicated) is peeled from the adhesive material whereupon the buckle assembly is placed in the desired position within the channel entering from the rear end 25 as hereinbefore described and firmly pressed in position thus adhesively securing the component 17 to the buckle assembly in the position clearly shown in FIG. 2.

A vertical slot 28 is formed downwardly from the upper edges 29 of the side members 20 and extends to adjacent the base 19 and a plurality of latching dogs or members 30 are formed on the inner surface 31 of the side members adjacent the rear surface 32 which defines the vertical slots 28, the purpose of which will hereinafter be described.

Figure 4:
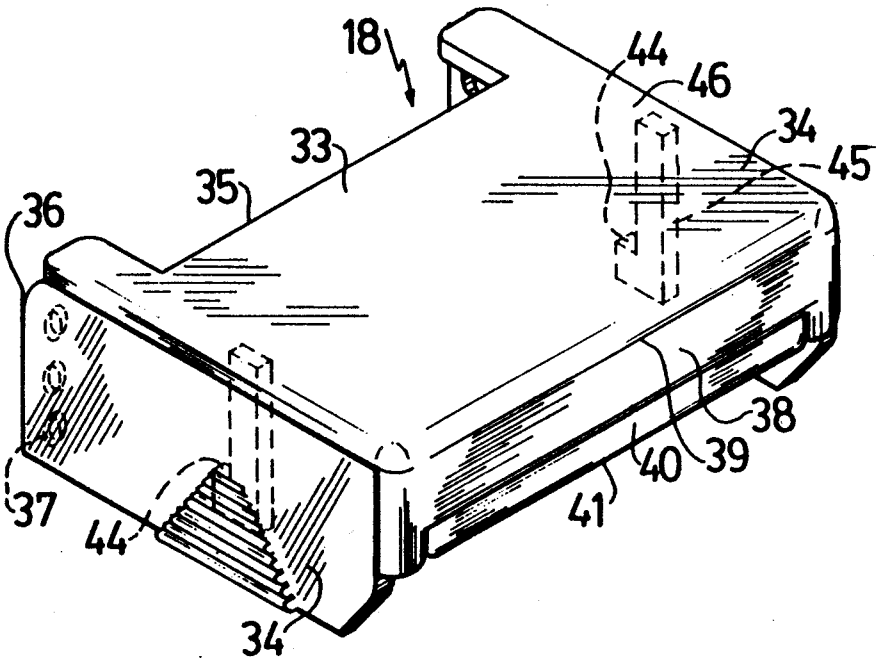
FIG. 4 is an enlarged isometric view of the cover portion per se broken away in part to show the interior thereof.

Reference to FIG. 4 will show the cover component 18 which also includes a planar upper plate 33 with a depending side wall 34 extending downwardly from each side edge of the plate 33 thus also forming a channel, the width of which is slightly larger than the width of the channel forming the base component 17.

The rear edge 35 of the upper plate terminates just forwardly of the rear ends 36 of the side walls and these rear ends are provided with a plurality of apertures 37 in vertical array one pair of which is selectively engageable with the aforementioned lugs 22 on the side members of the receiving component 17 thus hinging the cover component to the receiving component for fore and aft hinging movement between the closed position shown in FIG. 1 and the open position shown in FIG. 2. The plurality of apertures 37 is provided so that the distance between the panel 33 of the cover and the base 19 of the receiving component can be adjusted within limits to suit the thickness of the seat belt buckle assembly which will be engaged therebetween.

A transversely extending front flange 38 depends downwardly from the front edge 39 of the upper panel 33 and a transverse break-away portion 40 extends downwardly from the lower edge of this flanged portion 38 as clearly shown. When the device is used with buckle assemblies having a top button release 15 as illustrated in FIG. 1, the break-away portion 40 may be removed and the edge 41 thereof in conjunction with the front edge 42 of the base 19 of the receiving component defines a slot through which the tongue 10 of the other portion of the seat belt 11 may engage to engage within the receiving opening 14 of the buckle assembly portion 12.

However if a end release type buckle assembly is used as shown in FIG. 2, the transverse opening 14A is on the underside of the front of the buckle assembly and the transversely situated end release button 43 is situated above this opening thus leading to a thicker construction of the buckle assembly and requiring adjustment between the cove component 18 and the receiving component 17 by adjusting the hinging between the two components as hereinbefore described.

The break-off section then remains in place to cover the end release button 43 when the cover is in the closed or guarded position.

However as mentioned previously, it may be removed when used in conjunction with the top release buckle assemblies shown in FIG. 1.

Latch members or lugs 44 extend rearwardly from vertical bars 45 formed on the inner surfaces 46 of the side walls 34 and these bars together with the latch members slide downwardly within slots 28 when the cover is moved to the closed position with the latch members engaging and being held by the latch members 30. The relevant latch member finally engaged depends upon the vertical adjustment of the cove component 18 with the receiving component 17 as hereinbefore described.

Once latched, the release button for the seat belt buckle assembly is protected or guarded and cannot be reached until the cover is opened so that the button becomes unguarded.

Opening takes place by squeezing each side of the cover side walls 34 adjacent the lugs 46 thus moving these lugs inwardly towards one another and out of engagement from the latch members 30, it being appreciated that sufficient side clearance between the side walls 34 and the side members 20 is provided for this movement.

Once disengaged the cover may be pivoted rearwardly to the position shown in FIGS. 2 and 3 and the release button 15 or 43 may be activated to disengage the seat belt.

Finger gripping areas 48 may be formed on the outer surfaces of the side walls 34 of the cover component 18 adjacent the lugs 44 on the inner surface thereof.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A seat belt release guard for use with a seat belt assembly in which said seat belt assembly includes two belt sections with respective free ends a latch plate on one free end and a latch plate receiving buckle assembly on the other free end, said latch plate receiving buckle assembly including an anchor end secured to the respective belt section, and an opposite latch plate receiving free end latch means for engaging and retaining the latch plate and a latch release member thereon, said release guard comprising in combination a buckle assembly receiving component having a belt end and an opposite latch plate receiving end, and a cover component having a belt end, an opposite latch plate receiving end, and a pair of opposite side walls extending between the belt and latch plate receiving ends, the cover component being hingedly secured to said receiving component adjacent one end thereof and moveable in an arc extending in an end to end direction of said receiving component, from an open, unguarded buckle release position to a closed, guarded position covering the associated latch release member against access and preventing actuation of the latch release member, means to detachably latch said cover component to said receiving component when in the closed position, means responsive to pressure on the opposite side walls of the cover component to release said cover component from said receiving component, allowing said cover component to move to the open unguarded position and means to secure said receiving component to the associated buckle assembly.

2. The guard according to claim 1 in which said buckle assembly receiving component includes an open ended channel member having a base and a pair of upstanding side members one on each side edge of said base, the associated buckle assembly engaging within said channel and upon said base, when installed.

3. The guard according to claim 2 in which said cover component includes a channel member having a planar upper plate, with the side walls depending downwardly from opposite side edges of said upper plate, a belt end and an opposite latch plate receiving end, the belt end of said cover component being open, the latch plate receiving end of said cover component having a downturned flange extending across an upper portion of the latch plate receiving end, the latch plate receiving end of said cover component having an open lower portion and defining, with the buckle assembly receiving component, an entry slot for the associated latch plate of the seat belt, when said guard is in said closed, guarded position, said side walls of said cover component engaging over the outside of said receiving component, when closed.

4. The guard according to claim 3 in which said cover component includes hinge means on each side wall adjacent the belt end of the cover component, cooperating with a hinge pin extending outwardly from each side member of said receiving component adjacent the, belt end of the receiving component, said hinge means being adjustable to one of a plurality of vertical positions to adjust the spacing of said cover component relative to said receiving component for the reception of associated seat belt buckle assemblies of different thicknesses.

5. The guard according to claim 4 in which said downturned flange includes a transversely extending break-away portion, said break-away portion remaining in place when said guard is used with an associated seat belt receiving buckle assembly includes a release bar across the upper front edge thereof and removed when the associated seat belt receiving buckle assembly includes a release button on the upper surface thereof.

6. The guard according to claim 4 in which said means to detachably latch said cover component to said receiving component includes a resilient latch mechanism, said latch mechanism including a latch member on one of said components and a lug on the other of said components, said lug engaging said latch member when said guard is closed.

7. The guard according to claim 6 which includes a plurality of lugs for selective engagement with said latch member depending upon the position of said hinge mean between said cover component and said receiving component.

8. The guard according to claim 7 in which said lugs are situated on the inner surfaces of the side members of said receiving component, a vertical slot being formed through said side members of said receiving component, said latch members extending inwardly from the inner surfaces of the side walls of said cover component and extending rearwardly and sliding downwardly along said slots as said cover component is moved from the unguarded to the guarded position.

9. The guard according to claim 3 in which said means to detachable latch said cover component to said receiving component includes a resilient latch mechanism, said latch mechanism including a latch member on one of said components and a lug on the other of said components, said lug engaging said latch member when said guard is closed, said latch member and said lug being situated between said side walls of said cover component and said side members of said receiving component in cooperating relationship.

10. The guard according to claim 1 in which said cover component includes a channel member having a planar upper plate, with the side walls depending downwardly from opposite side edges of said upper plate, a belt end and an opposite latch plate receiving end, the belt end of said cover component being open, the latch plate receiving end of said cover component having a downturned flange extending across an upper portion of the latch plate receiving end, the latch plate receiving end of said cover component having an open lower portion and defining, with the buckle assembly receiving component, an entry slot for the associated latch plate of the seat belt, when said guard is in said closed, guarded position, said side walls of said cover component engaging over the outside of said receiving component, when closed.

11. The guard according to claim 1 in which said means to detachably latch said cover component to said receiving component includes a resilient latch mechanism said latch mechanism including a latch member on one of said components and a lug on the other of said components, said lug engaging said latch member when said guard is closed.

12. The guard according to claim 11 in which said means to release said lug from said latch member includes resilient side walls of said cover component, inward pressure thereof moving said side walls inwardly thereby disengaging said latch member from said lug.

13. A seat belt release guard for use with a seat belt assembly in which said seat belt assembly includes two belt sections with respective free ends, a latch plate on one free end and a latch plate receiving buckle assembly on the other free end, said latch plate receiving buckle assembly including an anchor end secured to the respective belt section, and an opposite latch plate receiving free end, latch means for engaging and retaining the latch plate and a latch release member thereon, said release guard comprising in combination a buckle assembly receiving component comprising an open ended channel member having a base, a pair of upstanding side members on opposite sides of said base, a belt end and an opposite latch plate receiving end, the associated buckle assembly engaging within said channel and upon said base, when installed, and a cover component having a belt end, an opposite latch plate receiving end, and a pair of opposite side walls extending between the belt and latch plate receiving ends, the cover component being hingedly secured to said receiving component adjacent one end thereof and moveable in an arc extending in an end to end direction of said receiving component, from an open, unguarded buckle release position to a closed, guarded position covering the associated latch release member against access and preventing actuation of the latch release member, means to detachably latch said cover component to said receiving component when in the closed position, means responsive to pressure on the opposite side walls of the cover component to release said cover component from said receiving component, allowing said cover component to move to the open unguarded position and means to secure said receiving component to the associated buckle assembly including adhesive means on the upper surface of said base.

14. The guard according to claim 13 in which said cover component includes a channel member having a planar upper plate, with the side walls depending downwardly from opposite side edges of said upper plate, a belt end and an opposite latch plate receiving end, the belt end of said cover component being open, the latch plate receiving end of said cover component having a downturned flange extending across an upper portion of the latch plate receiving end, the latch plate receiving end of said cover component having an open lower portion and defining, with the buckle assembly receiving component, an entry slot for the associated latch plate of the seat belt, when said guard is in said closed, guarded position, said walls of said cover component engaging over the outside of said receiving component, when closed.

15. A seat belt release guard for use with a seat belt assembly in which said seat belt assembly includes two belt sections with respective free end, a latch plate on one free end and a latch plate receiving buckle assembly on the other free end, said latch plate receiving buckle assembly including an anchor end secured to the respective belt section, and an opposite latch plate receiving free end, latch means for engaging and retaining the latch plate and a latch release member thereon, said release guard comprising in combination a buckle assembly receiving component having a rear end and an opposite front end, and a cover component having a rear end and an opposite front end, the cover component being hingedly secured to said receiving component adjacent one end thereof and moveable in an arc extending in an end to end direction of said receiving component, from an open, unguarded buckle release position to a closed, guarded position covering the associated latch release member against access, said cover component including a channel member having an upper plate, two side walls depending from opposite sides of the upper plate, a downturned flange extending across the front end of the cover component, the front end of the cover component having an open lower portion defining, with the front end of the buckle assembly receiving component, an entry slot for the latch plate, when the guard is in the closed, guarded position, the side walls of the cover component engaging over the outside of the receiving component, hinge means on each side wall of the cover component adjacent the rear end thereof, cooperating with a hinge pin extending outwardly from each side member of said receiving component adjacent the rear end thereof, said hinge means being adjustable to one of a plurality of vertical positions to adjust the spacing of said cover component relative to said receiving component for the reception of associated seat belt buckle assemblies of different thicknesses, means to detachably latch said cover component to said receiving component when in the closed position, means to selectively release said cover component from said receiving component allowing said cover component to move to the open unguarded position and means to detachably secure said release guard to the associated buckle assembly.

16. The guard according to claim 15 in which said downturned flange includes a transversely extending break-away portion, said break-away portion remaining in place when said guard is used with an associated seat belt receiving buckle assembly includes a release bar across the upper front edge thereof and removed when the associated seat belt receiving buckle assembly includes a release button on the upper surface thereof.

17. A seat belt release guard for use with a seat belt assembly in which said seat belt assembly includes two belt sections with respective free ends, a latch plate on one free end and a latch plate receiving buckle assembly on the other free end, said latch plate receiving buckle assembly including an anchor end secured to the respective belt section, and an opposite latch plate receiving free end, latch means for engaging and retaining the latch plate and a latch release member thereon, said release guard comprising in combination a buckle assembly receiving component having a rear end and an opposite front end, and a cover component having a rear end and an opposite front end, the cover component being hingedly secured to said receiving component adjacent one end thereof and moveable in an arc extending in an end to end direction of said receiving component, from an open, unguarded buckle release position to a closed, guarded position covering the associated latch release member against access, said cover component including a channel member having an upper plate, two side walls depending from opposite sides of the upper plate, a downturned flange extending across the front end of the cover component, the front end of the cover component having an open lower portion defining with the front end of the receiving component, an entry slot for the latch plate, when the guard is in the closed, guarded position, the side walls of the cover component engaging over the outside of the receiving component, said downturned flange including a transversely extending break-away portion, said break-away portion remaining in place when said guard is used with an associated seat belt receiving buckle assembly includes a release bar across the upper front edge thereof and removed when the associated seat belt receiving buckle assembly includes a release button on the upper surface thereof, means to detachably latch said cover component to said receiving component when in the closed position, means to selectively release said cover component from said receiving component to move said cover component to the open unguarded position and means to detachably secure said release guard to the associated buckle assembly.

18. The guard according to claim 17 in which said means to detachably latch said cover component to said receiving component includes a resilient latch mechanism, said latch mechanism including a latch member on one of said components and a lug on the other of said components, said lug engaging said latch member when said guard is closed.

* * * * *